US011187249B2

(12) United States Patent
Sishtla et al.

(10) Patent No.: US 11,187,249 B2
(45) Date of Patent: Nov. 30, 2021

(54) SILENCER, AND CENTRIFUGAL COMPRESSOR AND REFRIGERATION SYSTEM HAVING THE SAME

(71) Applicant: Carrier Corporation, Farmington, CT (US)

(72) Inventors: Vishnu M. Sishtla, Manlius, NY (US); Kai Deng, Shanghai (CN); Zhanbo Du, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 679 days.

(21) Appl. No.: 16/074,326

(22) PCT Filed: Jan. 23, 2017

(86) PCT No.: PCT/US2017/014534
§ 371 (c)(1),
(2) Date: Jul. 31, 2018

(87) PCT Pub. No.: WO2017/136173
PCT Pub. Date: Aug. 10, 2017

(65) Prior Publication Data

US 2021/0190093 A1 Jun. 24, 2021

(30) Foreign Application Priority Data

Feb. 5, 2016 (CN) ..... 201610081505.4

(51) Int. Cl.
*F04D 29/66* (2006.01)
*F04D 29/44* (2006.01)
*F04D 29/62* (2006.01)

(52) U.S. Cl.
CPC ..... *F04D 29/663* (2013.01); *F04D 29/441* (2013.01); *F04D 29/624* (2013.01)

(58) Field of Classification Search
CPC ..... F04D 29/663; F04D 29/624; F04D 29/441
See application file for complete search history.

(56) References Cited

U.S. PATENT DOCUMENTS 4,504,188 A * 3/1985 Traver ..... F04D 29/441 415/1
4,534,056 A 8/1985 Feilchenfeld et al.
(Continued)

FOREIGN PATENT DOCUMENTS

CN 1965154 A 5/2007
CN 101501303 A 8/2009
(Continued)

OTHER PUBLICATIONS

Chinese First Office Action for application CN 20160081505.4, dated Nov. 15, 2019,10 pages.
(Continued)

*Primary Examiner* — Aaron R Eastman
(74) *Attorney, Agent, or Firm* — Cantor Colburn LLP

(57) ABSTRACT

The present invention provides a silencer, including: a silencer housing having an annular plate-like structure, with an annular mounting chamber formed therein; a silencing pad disposed in the mounting chamber; and a positioning portion disposed on the silencer housing and used for fastening the silencer housing. The silencer according to the embodiment of the present invention has an integrated structure, and can desirably avoid the problem of mounting unflatness in a separated structure. Moreover, the silencing pad therein is disposed to surround the entire silencer, which can provide a sound absorption and noise reduction effect more efficiently.

22 Claims, 7 Drawing Sheets

(56) References Cited

U.S. PATENT DOCUMENTS

| | | | | |
|---|---|---|---|---|
| 4,558,298 | A | 12/1985 | Kawai et al. | |
| 5,173,020 | A | 12/1992 | Ebbing et al. | |
| 5,249,919 | A * | 10/1993 | Sishtla | F04D 29/664 181/202 |
| 5,255,341 | A | 10/1993 | Nakajima | |
| 5,952,626 | A | 9/1999 | Zaharia | |
| 6,155,777 | A | 12/2000 | Aschenbruck et al. | |
| 6,397,976 | B1 | 6/2002 | Hale et al. | |
| 8,020,672 | B2 | 9/2011 | Lin et al. | |
| 2002/0079158 | A1 | 6/2002 | Liu | |
| 2007/0098253 | A1 | 5/2007 | Crespi et al. | |
| 2013/0025967 | A1* | 1/2013 | Seib | F04D 29/663 181/292 |
| 2014/0006034 | A1 | 1/2014 | Takeuchi | |
| 2016/0031675 | A1 | 2/2016 | Silvennoinen et al. | |
| 2016/0230778 | A1* | 8/2016 | Mekid | G10K 11/172 |
| 2019/0242408 | A1* | 8/2019 | Sishtla | F04D 17/12 |
| 2020/0109721 | A1* | 4/2020 | Hu | F04D 29/663 |

FOREIGN PATENT DOCUMENTS

| | | | |
|---|---|---|---|
| CN | 102303797 | A | 1/2012 |
| CN | 102730497 | A | 10/2012 |
| CN | 202500832 | U | 10/2012 |
| CN | 103498818 | A | 1/2014 |
| CN | 108730237 | A * | 11/2018 |
| DE | 19608382 | A1 | 9/1997 |
| EP | 1602810 | A1 | 12/2005 |
| JP | H05172099 | A | 7/1993 |
| JP | 3876011 | B2 | 1/2007 |
| JP | 2014105049 | A | 6/2014 |
| WO | 2011104807 | A1 | 9/2011 |
| WO | 2012065360 | A1 | 5/2012 |

OTHER PUBLICATIONS

International Search Report and Written Opinion for PCT/US2017/014534, dated Apr. 24, 2017, 11 pages.

Chinese Office Action for Application No. 2020061602201810; dated Jun. 19, 2020; 10 Pages.

* cited by examiner

SILENCER, AND CENTRIFUGAL COMPRESSOR AND REFRIGERATION SYSTEM HAVING THE SAME

TECHNICAL FIELD

The present invention relates to the improvement on a refrigeration system, and in particular, to the improvement on noise reduction of a centrifugal compressor in the refrigeration system.

BACKGROUND ART

A refrigeration system having a centrifugal compressor is widely applied to different industrial occasions, to implement gas compression or pressurization. In this process, due to a relatively high pressure ratio and a relatively low flow velocity, the noise level of the centrifugal compressor is obviously too high. For example, in the centrifugal compressor, one of the prominent noise sources is generated in a diffuser of the centrifugal compressor. Because the fluid generally passes through the diffuser at an extremely high flow velocity and gradually slows down in the channel to convert kinetic energy into pressure energy, the pressure of the fluid at this position is further improved, thus resulting in an obvious increase in the noise level at this position. In such a case, the excessively high noise may be severely harmful to the staff near the production site, and the continuous high noise may further lead to violent vibration of the machine structure, thus causing a failure of the machine.

To mitigate the noise problem, a silencer is generally applied to the centrifugal compressor. Most existing silencers employ a segmented structure. Such a structure is easy to machine and can effectively mitigate the noise phenomenon. However, it also has some inconvenience in application. For example, when a segmented silencer is mounted in the centrifugal compressor, a lot of deviations may be caused during assembly due to the machining precision, thus resulting in the problem of mounting unflatness, and this, on the contrary, greatly affects the noise reduction effect. In addition, there may also be clearance remaining in fitting between several segments; this also brings about a new noise source, and as a result, noise generated during working of the centrifugal compressor cannot be effectively reduced.

SUMMARY OF THE INVENTION

An objective of the present invention is to provide a silencer that can effectively reduce noise.

Another objective of the present invention is to provide a centrifugal compressor to which the silencer that can effectively reduce noise is applied.

A further objective of the present invention is to provide a refrigeration system including the centrifugal compressor.

In order to implement the foregoing objectives or other objectives, the present invention provides the following technical solutions.

According to an aspect of the present invention, a silencer is provided, including: a silencer housing having an annular plate-like structure, with an annular mounting chamber formed therein; a silencing pad disposed inside the mounting chamber; and a positioning portion disposed on the silencer housing and used for fastening the silencer housing.

According to another aspect of the present invention, a centrifugal compressor is further provided, including the silencer described above.

According to a further aspect of the present invention, a refrigeration system is further provided, including the centrifugal compressor described above.

DETAILED DESCRIPTION

Figure 1:
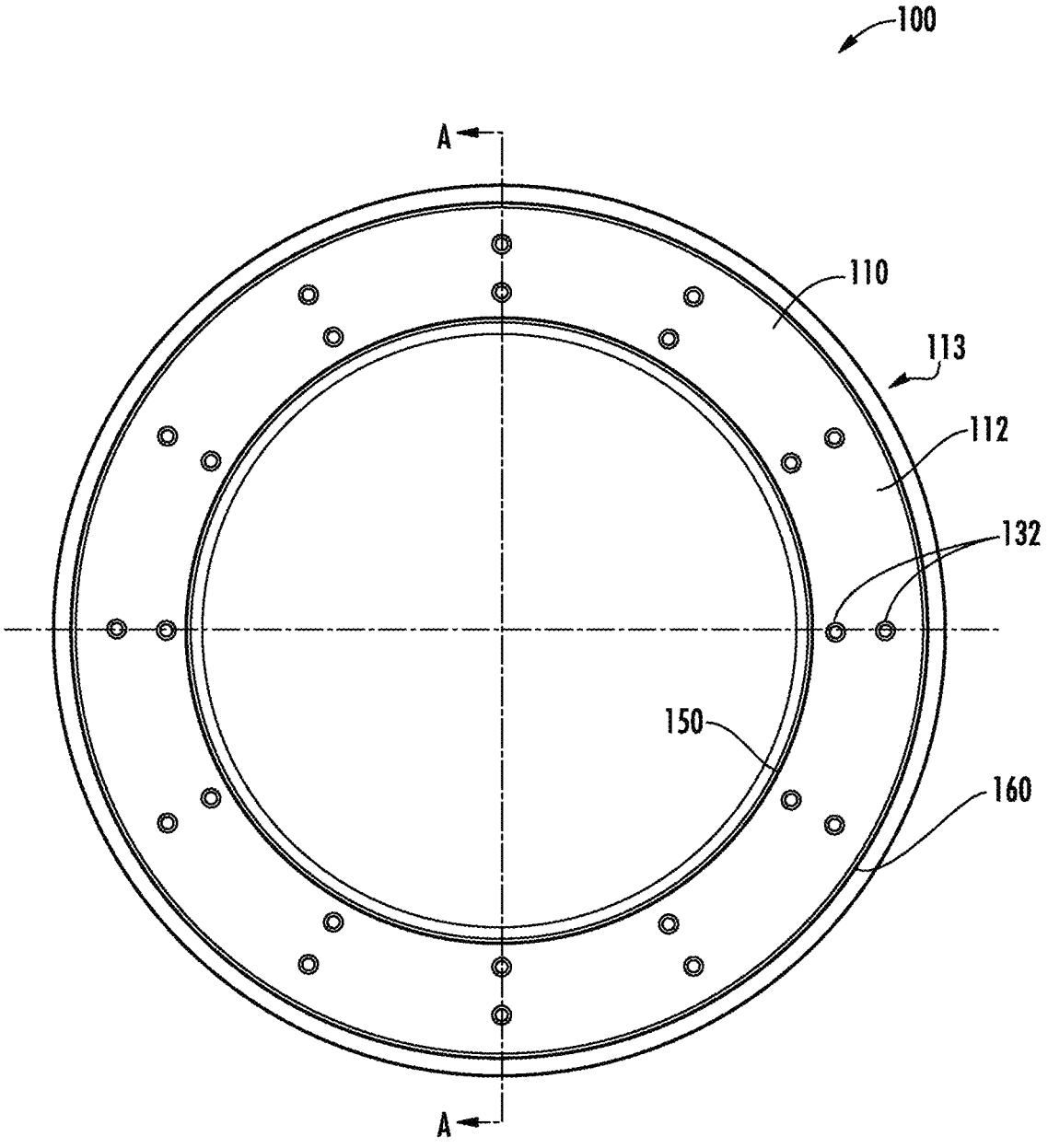
FIG. 1 is a front view of an embodiment of a silencer according to the present invention.
Figure 2:
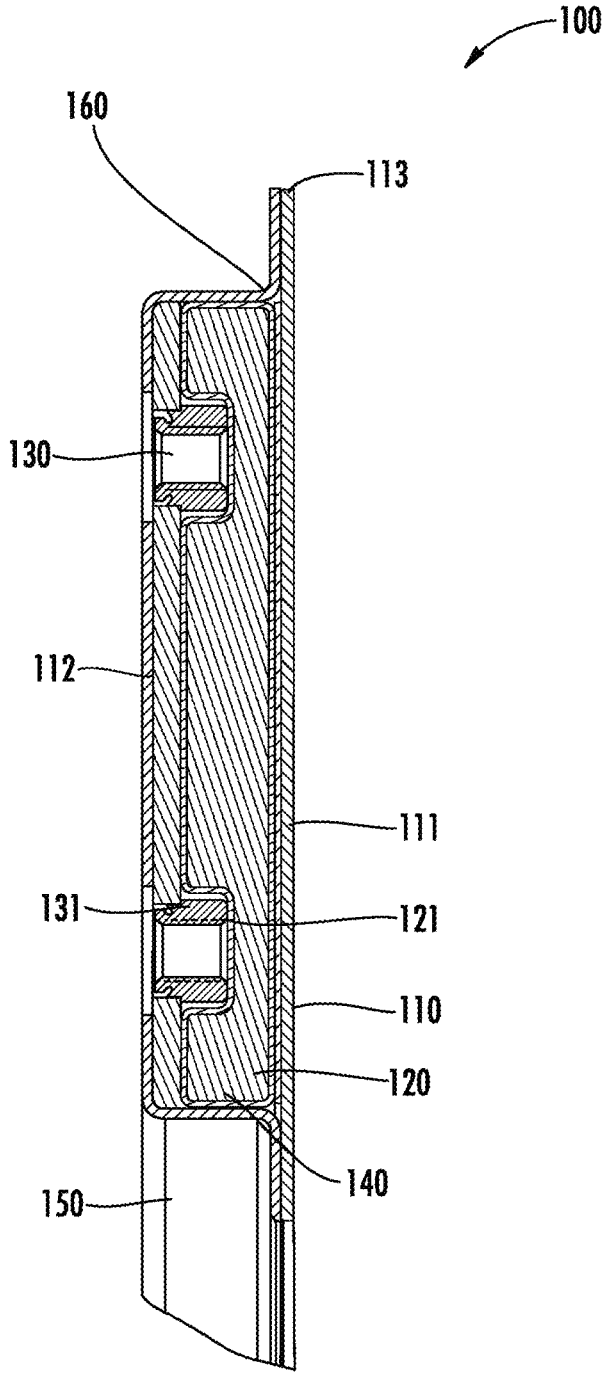
FIG. 2 is a partial side sectional view of an embodiment of the silencer according to the present invention.

Referring to FIG. 1 and FIG. 2, they show an embodiment of a silencer 100 according to the present invention. The silencer 100 includes a silencer housing 110, which is presented as an annular plate-like structure in this embodiment, and a cavity with an annular hollow space is formed in the silencer housing 110. The cavity is set as a mounting chamber 140. The mounting chamber 140 may be filled with a silencing pad 120, which plays a main role of absorbing sound and reducing noise in a working process of the silencer. In order to conveniently mount the silencer to a specified position, the silencer further includes a positioning portion 130. The positioning portion 130 is disposed on the silencer housing 110, for positioning the silencer housing 110 and fastening it to an actual application position. The silencer according to this embodiment of the present invention has an integrated structure, and can desirably avoid the problem of mounting unflatness in a separated structure. Moreover, the silencing pad 120 therein is disposed to surround the entire silencer, which can provide a sound absorption and noise reduction effect more efficiently. Optionally, the silencing pad 120 is uniformly arranged in the mounting chamber 140. Such an arrangement would provide a more uniform noise reduction effect, so that a fluid can be effectively denoised when flowing through any position on the surface of the silencer.

Components and parts of the silencer in the above embodiment will be described below. First of all, referring to the silencer housing 110, it includes a circulation surface 111 and a mounting surface 112 located on two sides of the plate-like structure respectively. The mounting surface 112 is a surface for providing a mounting interface, and in a use state, the mounting surface 112 should abut against a mounting position. The circulation surface 111 is a surface located on an external side and used for reducing sound and noise, and in a use state, the circulation surface 111 should be away from the mounting position and face a fluid channel. Therefore, the circulation surface 111 should be made as flat as possible, to avoid excessively blocking the fluid motion. In addition, the circulation surface 111 extends outward along a radial direction, to further form a flange 113. The purpose of the flange is to cover a possible assembly clearance between the silencer 100 and the mounting position, thereby making sure that the interior of the flow channel is kept flat.

In an implementation, the silencer housing 110 includes two metal plates forming the circulation surface 111 and the mounting surface 112 respectively, and the two metal plates are connected to each other at the flange 113 at the edge of the silencer housing 110, thus forming the complete housing and forming the mounting chamber 140 inside the housing.

Optionally, several micro pores may further be uniformly arranged on the circulation surface 111 of the silencer housing 110, thus forming conduction between an external flow channel and the silencing pad 120 disposed in the mounting chamber 140, so that noise generated by the fluid that passes there through is further reduced.

Optionally, when the needed silencer 100 is relatively large and thus the internal mounting chamber 140 is also relatively large, a large volume of silencing pad 120 is needed to fill in. This may cause a challenge to the structural strength of the silencer. Therefore, in order to reinforce the structural strength, several reinforcing portions for providing bearing strength may be disposed in the mounting chamber 140. As an implementation, this embodiment employs reinforcing ribs disposed along the circumference of the mounting chamber 140, to improve the structural strength of the silencer 100.

Next, refer to the silencing pad 120 of the silencer 100. The silencing pad 120 is the component that mainly plays the role of absorbing sound and reducing noise in a silencer. In this embodiment, in order to improve the noise reduction effect, the silencing pad 120 may be set as several laminated sound absorbing material layers, thus providing a better sound absorbing effect. As a specific implementation, during study of the present invention, it is found that a particularly prominent noise reduction effect can be achieved when asbestos layers are used as the sound absorbing material layers.

Then, refer to the positioning portion 130 of the silencer 100. The positioning portion 130 is a component for positioning the silencer and fastening it to a working position. In this embodiment, the positioning portion 130 includes first bolt mounting portions 131 and first mounting bolts 132 fitting the first bolt mounting portions 131. The first bolt mounting portions 131 are inserted into corresponding mounting grooves 121 in the silencing pad 120 via through holes opened on the mounting surface 112. In such a case, countersunk bolts are generally used, and at this point, only the side, where the mounting surface 112 is located, of the silencer housing 110 is provided with through holes, and the first bolt mounting portions 131 are thus inserted into the housing. Corresponding mounting grooves 121 should also be designed on the silencing pad 120 to provide the space for insertion of the first bolt mounting portions 131 into the housing. For such a structure, during assembly, it is only necessary to arrange the first mounting bolts 132 at the mounting position, and then screw, via the first bolt mounting portions 131, the mounting surface 112 of the silencer 100 till it abuts against the mounting position. In this case, in the silencer, the circulation surface exposed inside the flow channel does not have any protruding structure but has a very smooth structure. The silencer in this form can provide an excellent noise reduction effect. In this case, it should be noted that, in order to ensure the connection strength of this connection manner, a relatively large number of first bolt mounting portions 131 and first mounting bolts 132 may be disposed, and setting positions thereof are optimized in design. For example, the first bolt mounting portions 131 may be uniformly arranged along the circumferential direction of the silencer housing 110, and by comprehensively considering costs and the connection strength, the number thereof may be set as 12 approximately. Preferably, the first bolt mounting portions 131 may further be arranged in two columns, each column is uniformly arranged along the circumferential direction of the silencer housing 110, and the two columns of the first bolt mounting portions 131 are uniformly arranged along the radial direction of the silencer housing 110.

Certainly, when limited by some specific conditions, it is possible that there is not enough space at the mounting position for disposing the first mounting bolts 132. In this case, it may be necessary to make some modifications to the above embodiment of the present invention, to make it adapted to a new application environment.

Figure 3:
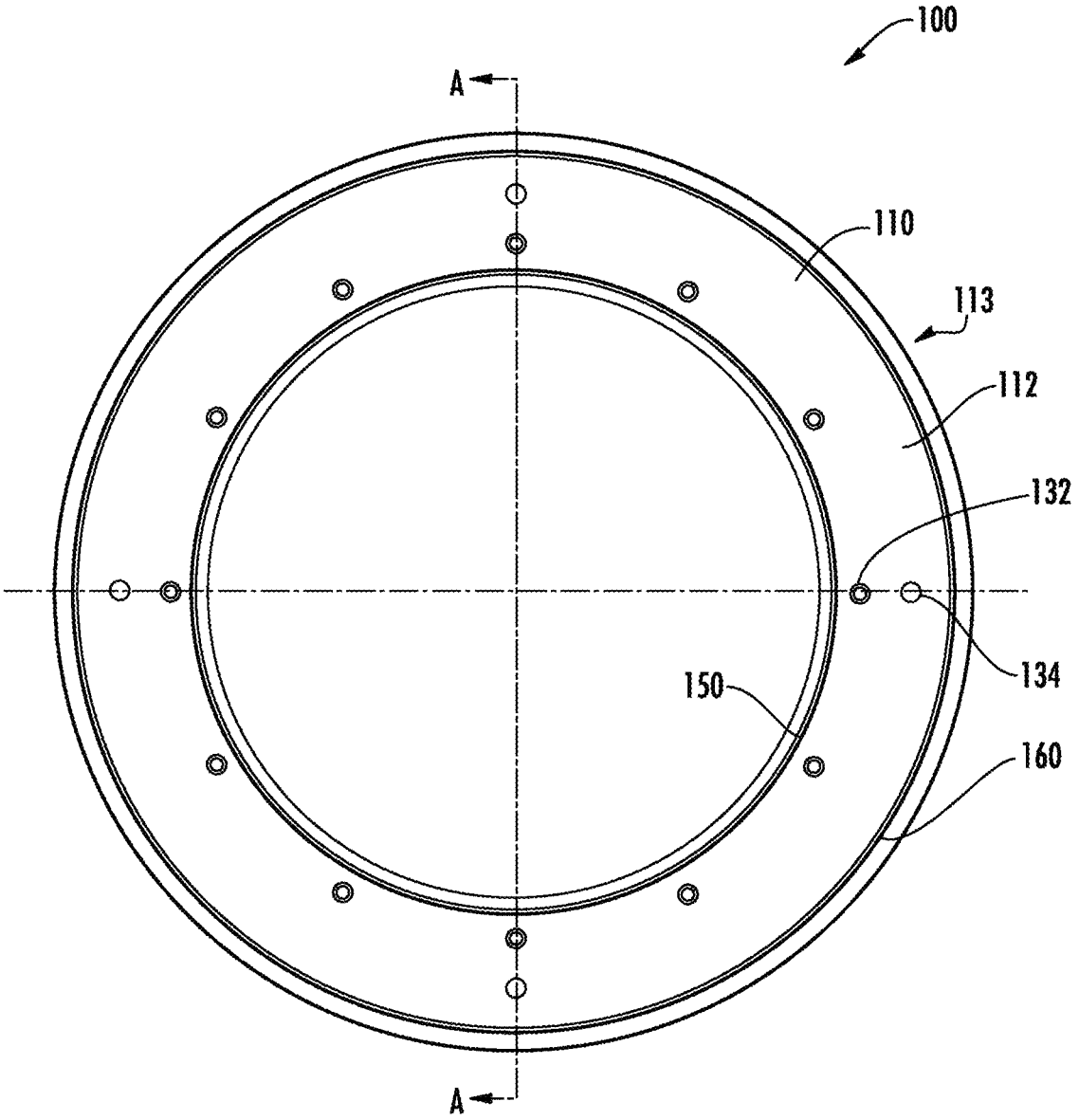
FIG. 3 is a front view of another embodiment of the silencer according to the present invention.
Figure 4:
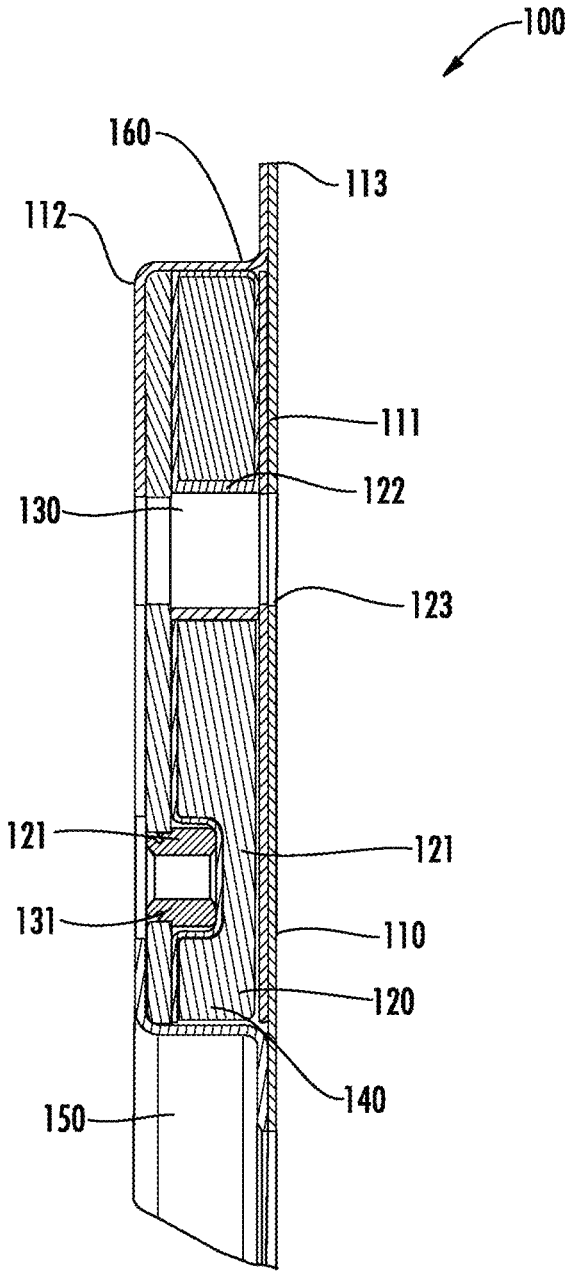
FIG. 4 is a partial side sectional view of another embodiment of the silencer according to the present invention.

Referring to FIG. 3 and FIG. 4, they show another embodiment of the silencer 100 according to the present invention. The silencer 100 also includes a silencer housing 110, a silencing pad 120 disposed in the silencer housing 110, and a positioning portion 130 disposed on the silencer housing 110. The foregoing components each have a structure similar to that in the previous embodiment. The difference mainly lies in that the positioning portion 130 is improved, and a connection relation between the positioning portion 130 and the silencer housing 110 as well as the silencing pad 120 is improved.

Specifically, the positioning portion 130 further includes second bolt mounting portions 133 and second mounting bolts 134 fitting the second bolt mounting portions 133; wherein the second bolt mounting portions 133 are disposed through the silencer housing 110. Therefore, it is necessary to modify the silencer housing 110, to open corresponding through holes on the mounting surface 112 thereof, and open corresponding through holes on the circulation surface 111 thereof. Meanwhile, it is also necessary to modify the silencing pad 120, to open corresponding mounting holes 122 thereon. The through holes on the silencer housing 110 and the mounting holes 122 on the silencing pad should all be aligned, so that the second bolt mounting portions 133 can run through and be inserted in the silencer housing 110. After that, the second mounting bolts 134 may be enabled to enter from the through holes on the circulation surface 111 and run through the entire second bolt mounting portions 133, so as to be firmly connected to the mounting position. The positioning portion in this form provides a more reliable connection between the silencer and the mounting position. However, a possible problem thereof is that: because there is a bolt head on the second mounting bolt 134, if the bolt head is still higher than the circulation surface and forms a protrusion after the second mounting bolt 134 is completely screwed into the second bolt mounting portion 133, it may cause unflatness of the circulation surface 111, thus affecting the internal fluid flow. Optionally, the through hole opened on the circulation surface 111 may be set as a stepped hole. In this way, after the second mounting bolt 134 is screwed into the second bolt mounting portion 133, the bolt head of the second mounting bolt 134 can be just inserted in the stepped hole, so that the circulation surface 111 can still keep flat. In this case, in the silencer, the circulation surface exposed inside the flow channel barely has any protruding structure and has a relatively smooth structure, and a quite high connection strength is achieved. The silencer of this form can also provide a desirable noise reduction effect. In this case, it should be noted that, while ensuring the connection strength of this connection manner, it is also necessary to consider the smooth degree of the circulation surface. Although there is fitting between the bolt head and the stepped hole, the flatness of the circulation surface is still worse than that of a complete smooth plane. Therefore, it is inappropriate to dispose too many second bolt mounting portions 133, for example, the number of the second bolt mounting portions 133 is controlled to be not greater than four, so as to take both the connection strength and the smooth degree of the circulation surface into account.

Optionally, the first bolt mounting portions 131 and the second bolt mounting portions 133 may also be used in combination. For example, the first bolt mounting portions 131 may be uniformly arranged along the circumferential direction of the silencer housing 110; similarly, the second bolt mounting portions 133 may also be uniformly arranged along the circumferential direction of the silencer housing 110. Besides, the number of the first bolt mounting portions 131 is made greater than the number of the second bolt mounting portions 133. As one of the examples, by comprehensively considering the costs and the connection strength, the number may be set as 12 approximately. As another example, by comprehensively considering the smoothness product of the circulation surface and the connection strength, the number may be set as 4 approximately. Moreover, the first bolt mounting portions 131 and the second bolt mounting portions 133 are arranged along the radial direction of the silencer housing 110, wherein the second bolt mounting portions 133 are arranged on the external side along the radial direction, while the first bolt mounting portions 131 are arranged on the internal side along the radial direction.

Figure 5:
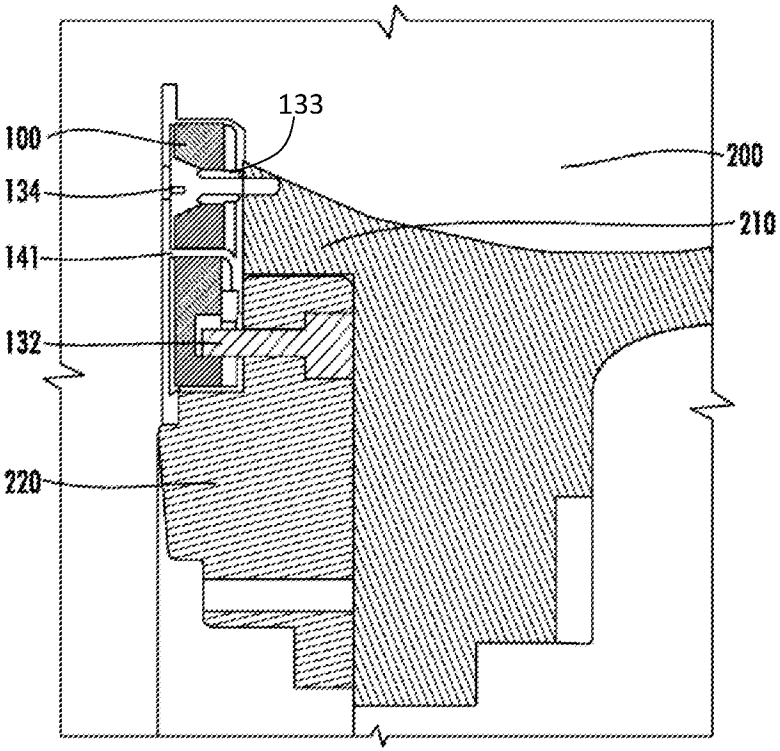
FIG. 5 is a partial sectional view of an embodiment of a centrifugal compressor mounted with the silencer of the present invention.
Figure 6:
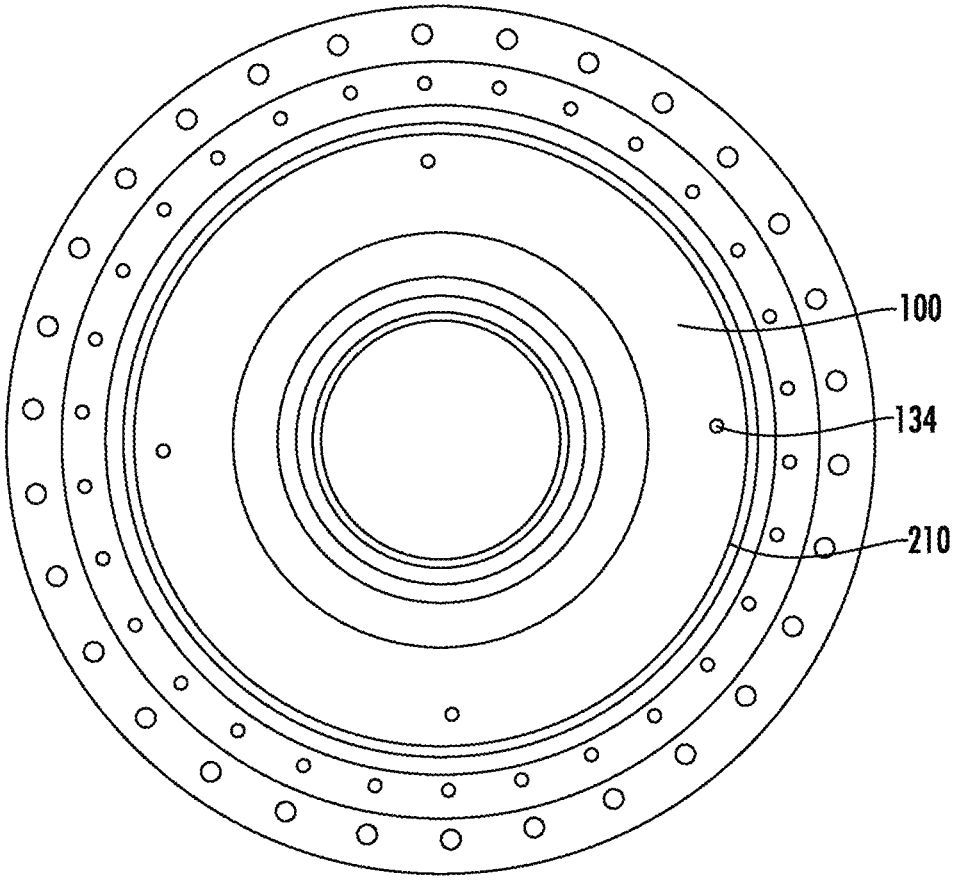
FIG. 6 is a front view of an embodiment of a centrifugal compressor mounted with the silencer of the present invention.

As another aspect of the present invention, referring to FIG. 5 and FIG. 6, they further provide an embodiment of a centrifugal compressor 200. The centrifugal compressor 200 includes a compressor base portion 210, a discharge wall 220, and a diffuser wall 230, wherein the discharge wall 220 and the diffuser wall 230 jointly form a diffuser flow channel 240. In this embodiment, the silencer 100 shown in FIG. 3 and FIG. 4 above is applied. Herein, the silencer is fastened to the discharge wall 220 via the first mounting bolts 132 and the second mounting bolts 134 respectively. In this way, a fluid passing through the diffuser flow channel 240 will be denoised at this place. Specifically, an annular mounting groove for mounting the silencer 100 is specially provided on the discharge wall 220. When the silencer 100 is mounted into the annular mounting groove, a close fit is formed between an annular inner hole 150 of the silencer 100 and an inner wall of the annular mounting groove. Meanwhile, an annular outer edge 160 of silencer 100 is made fit with an outer wall of the annular mounting groove, and a certain fitting clearance is reserved at this position, to facilitate assembly. After the assembly is finished, the fitting clearance is covered by the flange 113 on the silencer 100, and thus the smoothness of the circulation surface can still be ensured.

Figure 7:
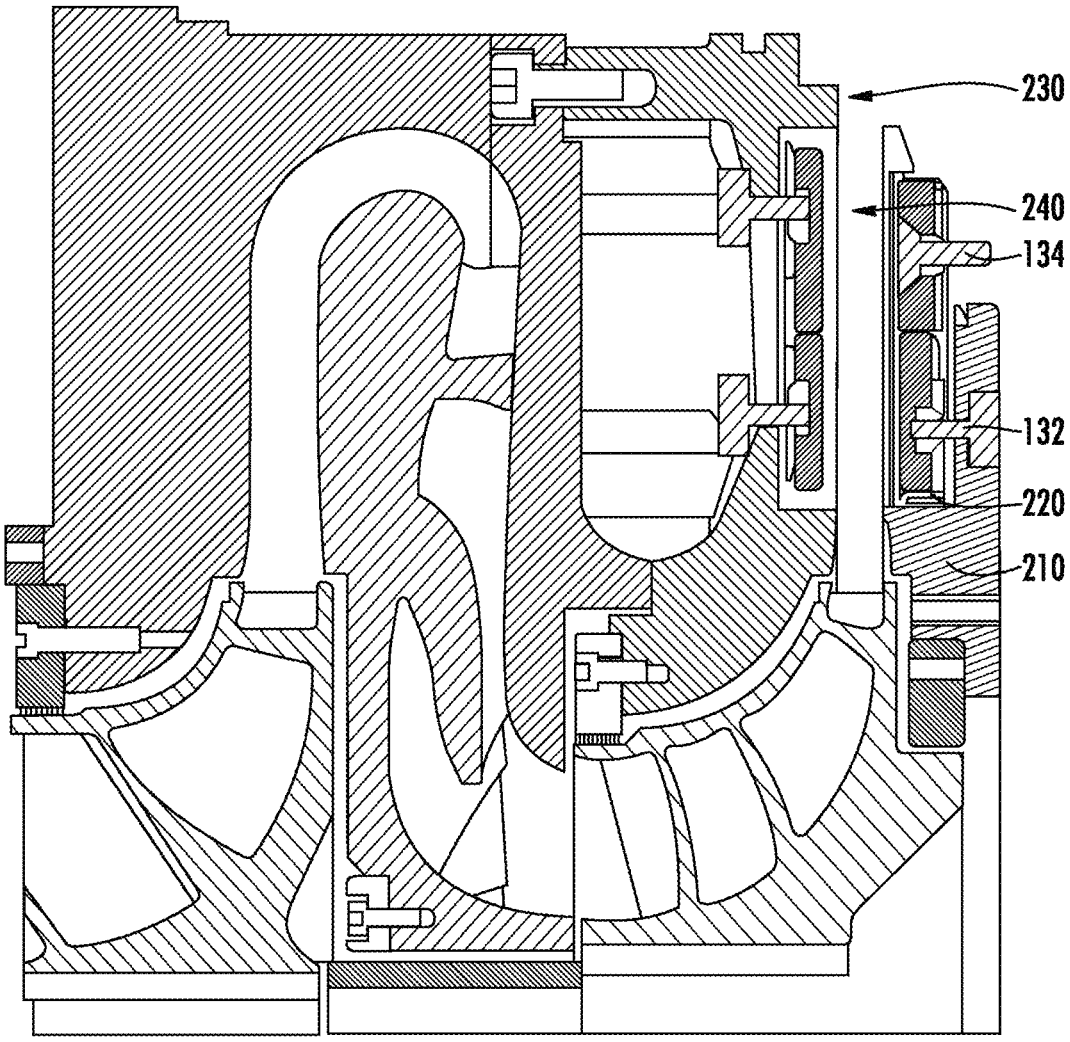
FIG. 7 is a partial sectional view of another embodiment of a centrifugal compressor mounted with the silencer of the present invention.

In addition, referring to FIG. 7, it shows another embodiment of the centrifugal compressor 200. Compared with the previous embodiment, the centrifugal compressor 200 has a similar structure, while the difference mainly lies in that the mounting position of the silencer 100 in the centrifugal compressor 200 is changed.

In the embodiment shown in FIG. 7, the silencer 100 is respectively mounted on a diffuser wall 230 and a discharge wall 220 in the centrifugal compressor 200, and is located at roughly corresponding positions on the wall surfaces of the diffuser wall 230 and the discharge wall 220. As for the specific mounting manner, reference can also be made to the foregoing embodiment, and therefore details are not described herein again.

For the centrifugal compressor shown in any one of FIG. 5 to FIG. 7, when the fluid passes through the diffuser flow channel 240 in which the silencer 100 is mounted, the noise thereof will be effectively reduced. Moreover, it is very simple to mount the silencer 100 in the centrifugal compressor 200, and there will be no extra problems such as unflatness.

Further, according to another aspect of the present invention, a refrigeration system is further provided, which includes the centrifugal compressor that uses the silencer in the foregoing embodiment, and therefore can also obtain the noise reduction effect brought about by the silencer. Therefore, a relatively healthy working environment is provided for operators, furthermore, vibration of the equipment is effectively reduced, and the service life thereof is improved.

In the description of the present invention, it should be understood that direction or position relations indicated by "upper", "lower", "front", "rear", "left", "right" and the like are direction or position relations based on the figures, are merely used to facilitate the description of the present invention and to simplify the description rather than indicating or implying that the indicated device or feature must have the specific direction or be constructed and operated in the specific direction, and therefore cannot be construed as a limitation to the present invention.

The above examples mainly describe the silencer of the present invention, and the centrifugal compressor and refrigeration system having the same. Although only some implementations of the present invention are described, persons of ordinary skill in the art should understand that the present invention may be implemented in many other manners without departing from the purport and scope of the present invention. Therefore, the illustrated examples and implementations are regarded as illustrative rather than limitative, and the present invention may cover various modifications and replacements without departing from the spirit and scope of the present invention as defined in the appended claims.

The invention claimed is:

1. A silencer, comprising:

a silencer housing having an annular plate-like structure, with an annular mounting chamber formed therein;

a silencing pad disposed in the mounting chamber; and a positioning portion disposed on the silencer housing and used for fastening the silencer housing;

wherein the silencer housing comprises a circulation surface for an air flow to flow through, and a mounting surface for use in mounting; the mounting surface and the circulation surface are located on two sides of the silencer housing respectively; and the positioning portion is disposed on the mounting surface and/or the circulation surface;

wherein the positioning portion comprises first bolt mounting portions and first mounting bolts fitting the first bolt mounting portions; wherein the first bolt mounting portions are inserted mounting grooves in the silencing pad via through holes opened on the mounting surface.

2. The silencer according to claim 1, wherein the silencing pad is uniformly arranged in the mounting chamber.

3. The silencer according to claim 1, wherein the first bolt mounting portions are uniformly arranged along the circumference of the silencer housing.

4. The silencer according to claim 3, wherein the first bolt mounting portions are uniformly arranged in two columns along a radial direction of the silencer housing.

5. The silencer according to claim 1, wherein the positioning portion further comprises second bolt mounting portions and second mounting bolts fitting the second bolt mounting portions; wherein the second bolt mounting portions run through the silencer housing by sequentially passing through through holes opened on the mounting surface, corresponding mounting holes in the silencing pad, and through holes opened on the circulation surface; and the second mounting bolts enter the second bolt mounting portions via the through holes on the circulation surface.

6. The silencer according to claim 5, wherein the through holes opened on the circulation surface are stepped holes, and the circulation surface can keep smooth after bolt heads of the second mounting bolts are mounted into the stepped holes.

7. The silencer according to claim 5, wherein the first bolt mounting portions and the second bolt mounting portions are arranged along a radial direction of the silencer housing, wherein the second bolt mounting portions are arranged on an external side along the radial direction, while the first bolt mounting portions are arranged on an internal side along the radial direction.

8. The silencer according to claim 5, wherein the number of the first bolt mounting portions is greater than that of the second bolt mounting portions.

9. The silencer according to claim 5, wherein the number of the second bolt mounting portions is not greater than four.

10. The silencer according to claim 1, wherein the silencing pad comprises several laminated sound absorbing material layers.

11. The silencer according to claim 10, wherein the sound absorbing material layers are asbestos layers.

12. The silencer according to claim 1, wherein several reinforcing portions for providing bearing strength are disposed in the mounting chamber.

13. A centrifugal compressor, comprising the silencer according to claim 1.

14. The centrifugal compressor according to claim 13, wherein a wall surface of a diffuser of the centrifugal compressor is provided with an annular mounting groove for mounting the silencer.

15. The centrifugal compressor according to claim 14, wherein the silencer is mounted in the annular mounting groove on the wall surface at either side and/or both sides of the diffuser.

16. The centrifugal compressor according to claim 14, wherein an annular inner hole of the silencer is adjacent to an inner wall of the annular mounting groove.

17. The centrifugal compressor according to claim 14, wherein an annular outer edge of the silencer fits an outer wall of the annular mounting groove, and a fitting clearance is reserved; and the fitting clearance is covered by a flange of the silencer.

18. A refrigeration system, comprising the centrifugal compressor according to claim 13.

19. A silencer, comprising:

a silencer housing having an annular plate-like structure, with an annular mounting chamber formed therein;

a silencing pad disposed in the mounting chamber; and a positioning portion disposed on the silencer housing and used for fastening the silencer housing;

wherein the silencer housing comprises a circulation surface for an air flow to flow through, and a mounting surface for use in mounting; the mounting surface and the circulation surface are located on two sides of the silencer housing respectively; and the positioning portion is disposed on the mounting surface and/or the circulation surface;

wherein the circulation surface side of the silencer housing radially extends outward to form a flange.

20. The silencer according to claim 19, wherein the silencer housing comprises two metal plates that form the circulation surface and the mounting surface respectively, and the two metal plates are connected at the flange.

21. A silencer, comprising:

a silencer housing having an annular plate-like structure, with an annular mounting chamber formed therein;

a silencing pad disposed in the mounting chamber; and a positioning portion disposed on the silencer housing and used for fastening the silencer housing;

wherein the silencer housing comprises a circulation surface for an air flow to flow through, and a mounting surface for use in mounting; the mounting surface and the circulation surface are located on two sides of the silencer housing respectively; and the positioning portion is disposed on the mounting surface and/or the circulation surface;

wherein several micro pores are uniformly arranged on the circulation surface of the silencer housing.

22. A silencer, comprising:

a silencer housing having an annular plate-like structure, with an annular mounting chamber formed therein;

a silencing pad disposed in the mounting chamber; and a positioning portion disposed on the silencer housing and used for fastening the silencer housing;

wherein several reinforcing portions for providing bearing strength are disposed in the mounting chamber;

wherein the reinforcing portions are reinforcing ribs arranged along the circumference of the mounting chamber.

* * * * *